US006618045B1

(12) United States Patent
Lin

(10) Patent No.: US 6,618,045 B1
(45) Date of Patent: Sep. 9, 2003

(54) DISPLAY DEVICE WITH SELF-ADJUSTING CONTROL PARAMETERS

(75) Inventor: Yun Lin, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/497,913

(22) Filed: Feb. 4, 2000

(51) Int. Cl.[7] ..... G06G 5/00
(52) U.S. Cl. ..... 345/207; 345/212; 345/214
(58) Field of Search ..... 345/204, 207, 345/212, 214, 102; 348/602, 603, 657, 658

(56) References Cited

U.S. PATENT DOCUMENTS 5,952,992 A * 9/1999 Helms ..... 345/102
6,094,185 A * 7/2000 Shirriff ..... 345/102
6,118,455 A * 9/2000 Hidaka et al. ..... 345/589
6,229,577 B1 * 5/2001 Barth et al. ..... 348/227

OTHER PUBLICATIONS

IEEE, Color TV, 1983, pp. 317–318.*
TV & Video Technology, pp. 118–119, 1997.*

* cited by examiner

*Primary Examiner*—Vijay Shankar
(74) *Attorney, Agent, or Firm*—Lee & Hayes, PLLC

(57) ABSTRACT

Methods and arrangements are provided that automatically adjust various operating settings associated with a display device in response to detected lighting conditions. The methods and arrangements respond to dynamically changing light conditions in an effort to significantly maintain the output quality of the display as previously established by the user. Memory is provided and configured to store at least one user preference value. At least one display parameter controller unit operatively associated with the display device is also provided and configured to respond to a parameter setting. At least one sensor unit, which is responsive to light, is configured to output a detected light value to logic. The logic is operatively coupled to the memory, the display parameter controller unit and the sensor unit. The logic is configured to output the parameter setting to the parameter controller unit based on the user preference value and the detected light value. Thus, for example, the user can establish a preferred setting for the brightness, contrast, color, etc., for a given lighting condition. The logic can be further configured to output the parameter setting based on the preference value, detected light value, and specified curve-fitting data.

16 Claims, 2 Drawing Sheets

DISPLAY DEVICE WITH SELF-ADJUSTING CONTROL PARAMETERS

TECHNICAL FIELD

This invention relates to computers, and more particularly to methods and arrangements that dynamically adjust certain operating settings associated with a computer monitor or display in response to detected environmental conditions.

BACKGROUND OF THE INVENTION

Computers are the tools of choice for many industries. Computers come in many shapes and sizes and can be found within traditional office environments, manufacturing facilities, automobiles, farm equipment, ships at sea, etc. Computers are also becoming more portable as witnessed by the recent growth in laptops, palm computers, enhanced cellular telephones, global positioning systems, etc. One common requirement shared by these various general-purpose and special-purpose computers is the need to interface with the user. User input is typically provided by a keypad, touch screen, mouse, microphone, or the like.

User output is usually limited to visual, audio and print outputs. Most common of these three outputs is obviously the visual output, which is displayed for the user to see on a monitor or other display device. Cathode ray tubes (CRTs) continue to be the mainstay in desktop/workstation computing because they provide a high-quality output at a relatively low cost. CRTs can also be implemented as projectors, for example, as in the case of large screen projection televisions. Flat-panel displays, such as, plasma displays and liquid crystal displays are used in portable computers/devices and in many special-purpose computing devices/appliances that have other limiting requirements. Flat-panel displays are also available for use with general-purpose desktop/workstation computers; however, their size tends to be limited when compared to CRTs and they are currently very expensive.

In the future, it is expected that the demand for both CRTs and flat-panel displays will remain strong. This is especially true if recent trends continue to merge certain appliances, such as, the television with the computer, e.g., high-definition television (HDTV), etc. Regardless of the type of monitor/display or its underlying purpose, there is a need for the user to be able to "see" the information that is being displayed.

Several factors can prevent the user from seeing the information. For example, a display may have a glare associated with office lights reflected from the face of the display. To help reduce glare many displays have anti-reflective coatings applied to the face. Usually, however, the user is required to make physical adjustments to the display to properly angle the face. This works fairly well for statically lighted environments, such as, an interior office space. Unfortunately, for dynamically lighted environments, such as, an office with windows/doors to the outside or vehicles/users traveling about, there may be a need to repeatedly make physical adjustments to the display. Furthermore, as most portable laptop computer users can attest, there is a need to make periodic adjustments to the display settings in addition to physically turning/tilting the display; such adjustments include attempting to balance the brightness and contrast settings, and maybe the color saturation setting, to best see the information being displayed. Many users become frustrated with this continual need to make such adjustments. Indeed, some users choose to suffer through with a poorly configured display rather than make the changes. Over time, this may lead to ergonomic problems for the user.

Consequently, there is a need for methods and arrangements that automatically adjust various operating settings associated with the display in response to detected environmental conditions.

SUMMARY OF THE INVENTION

Methods and arrangements are provided that automatically adjust various operating settings associated with a display in response to detected environmental conditions. The methods and arrangements respond to dynamically changing environmental conditions in an effort to significantly maintain the output quality of the display as requested by the user.

With this in mind, the above stated needs and others are met by an arrangement for use with a display device. The arrangement includes memory that is configured to store at least one user preference value. The arrangement also includes at least one display parameter controller unit operatively associated with the display device. The display parameter controller unit is configured to respond to a parameter setting. At least one sensor unit, which is responsive to light, is configured to output a detected light value to logic. The logic, in this case, is operatively coupled to the memory, the display parameter controller unit and the sensor unit. The logic is configured to output the parameter setting to the parameter controller unit based on the user preference value and the detected light value. Thus, for example, the user can establish a preferred setting for the brightness, contrast, color, etc., for a given lighting condition and the logic will monitor the lighting condition and make changes to the display as needed.

The logic can be further configured to output the parameter setting based on the preference value, detected light value, and specified curve-fitting data. By way of example, a plurality of preference values can be compared and/or otherwise applied to curve fitting data to determine at least one additional significantly preferred preference value. This might apply in lighting conditions that fall somewhere between or outside of the user's "bright environment" preference value and "dim environment" preference value.

In certain implementations, the sensor unit can be configured to respond to light falling within a selected portion of the visible light spectrum and/or light coming from a specific direction with respect to the sensor unit.

In certain further implementations, the arrangement is included within a display device that is part of a system that also includes a computer.

A method for use with a display device is also provided to meet the above stated needs and others. Here, the method includes selectively measuring light near a display screen, and determining a setting for at least one display device parameter setting based on a comparison of the measured light with at least one previously recorded light level having at least one previously recorded corresponding preference value. In certain implementations, the method includes comparing the measured light with a plurality of preference values to determine at least one additional significantly preferred preference value based on at least a portion of the plurality of preference values and curve fitting data. The method can also include adjusting the display device using the determined display device parameter setting.

BRIEF DESCRIPTION OF THE DRAWINGS

A more complete understanding of the various methods and arrangements of the present invention may be had by reference to the following detailed description when taken in conjunction with the accompanying drawings wherein.

DETAILED DESCRIPTION

Figure 1:
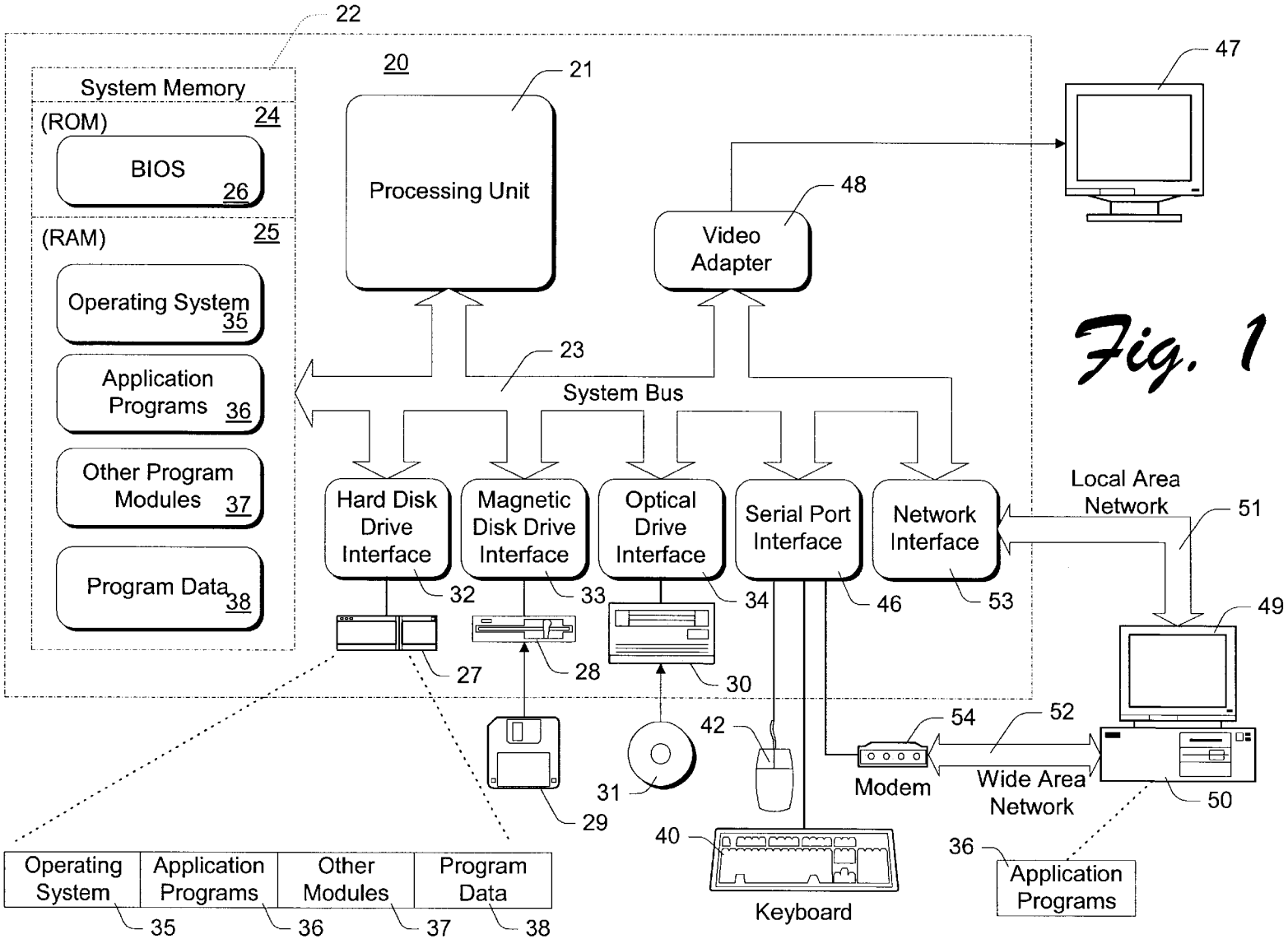
FIG. 1 is a block diagram depicting an exemplary computer system having a display configured to be operatively responsive to detected changes in certain environmental conditions.

As shown in FIG. 1, computer 20 includes one or more processors or processing units 21, a system memory 22, and a bus 23 that couples various system components including the system memory 22 to processors 21. Bus 23 19 represents one or more of any of several types of bus structures, including a memory bus or memory controller, a peripheral bus, an accelerated graphics port, and a processor or local bus using any of a variety of bus architectures.

The system memory includes read only memory (ROM) 24 and random access memory (RAM) 25. A basic input/output system (BIOS) 26, containing the basic routines that help to transfer information between elements within computer 20, such as during start-up, is stored in ROM 24.

Computer 20 further includes a hard disk drive 27 for reading from and writing to a hard disk, not shown, a magnetic disk drive 28 for reading from and writing to a removable magnetic disk 29, and an optical disk drive 30 for reading from or writing to a removable optical disk 31 such as a CD ROM, DVD ROM or other optical media. The hard disk drive 27, magnetic disk drive 28 and optical disk drive 30 are each connected to bus 23 by applicable interfaces 32, 33 and 34, respectively.

The drives and their associated computer-readable media provide nonvolatile storage of computer readable instructions, data structures, program modules and other data for computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, random access memories (RAMs) read only memories (ROM), and the like, may also be used in the exemplary operating environment.

A number of program modules may be stored on the hard disk, magnetic disk 29, optical disk 31, ROM 24, or RAM 25, including an operating system 35, one or more application programs 36, other program modules 37, and program data 38. A user may enter commands and information into computer 20 through input devices such as keyboard 40 and pointing device 42. Other input devices (not shown) may include a microphone, joystick, game pad, satellite dish, scanner, or the like. These and other input devices are connected to the processing unit 21 through an interface 46 that is coupled to bus 23.

A monitor 47 or other type of display device is also connected to bus 23 via an interface, such as a video adapter 48. In addition to the monitor, personal computers typically include other peripheral output devices (not shown) such as speakers and printers.

Computer 20 can operate in a networked environment using logical connections to one or more remote computers, such as a remote computer 50. Remote computer 50 may be another personal computer, a server, a router, a network PC, a peer device or other common network node, and typically includes many or all of the elements described above relative to computer 20. The logical connections depicted in FIG. 2 include a local area network (LAN) 51 and a wide area network (WAN) 52. Such networking environments are commonplace in offices, enterprise-wide computer networks, intranets, and the Internet.

When used in a LAN networking environment, computer 20 is connected to the local network 51 through a network interface or adapter 156. When used in a WAN networking environment, computer 20 typically includes a modem 54 or other means for establishing communications over the wide area network 52, such as the Internet. Modem 54, which may be internal or external, is connected to bus 23 via interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Figure 2:
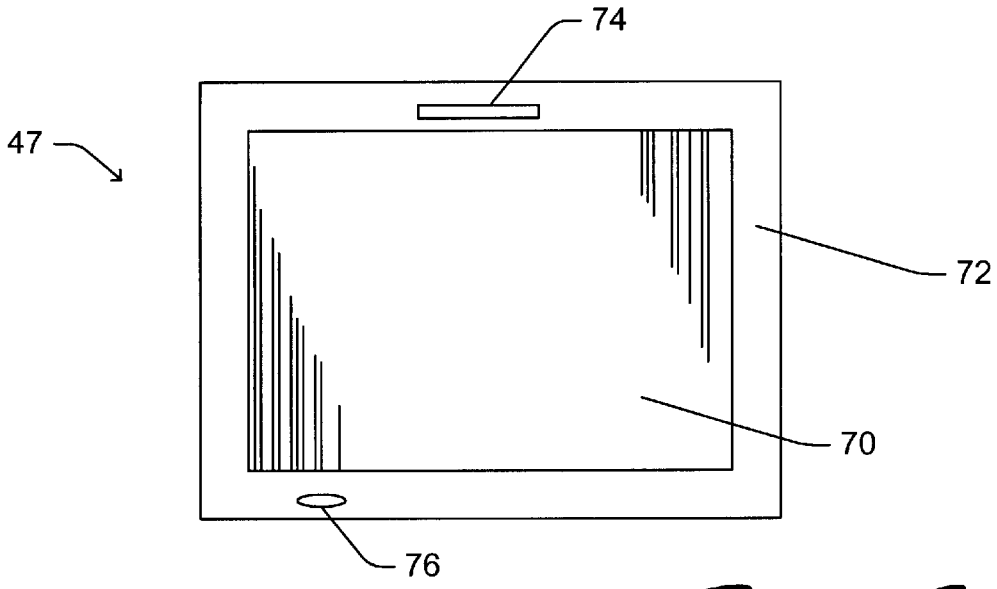
FIG. 2 is an illustrative depiction of the front of a display, for example, as in FIG. 1, having at least one environmental sensor arranged to detect changes in certain environmental conditions.

FIG. 2 illustratively depicts a front face of display 47. As shown in this example, the front face of display 47 includes a screen 70 that is surrounded by a portion of a housing 72. Screen 70 can be part of a cathode ray tube (CRT), flat-panel display, or the like.

At least one environment sensor 74 is arranged near the screen and configured to detect certain changes in the lighting environment surrounding display 47 that may affect the user's ability to see the information being displayed. For example, in certain implementations environment sensor 74 measures an approximate level of ambient light falling on screen 70. In other implementations, environment sensor 74 is arranged to measure an approximate amount of light in one or more specific frequency bands in the visible light spectrum. In still other implementations, environment sensor 74 is arranged to measure an approximate amount of light falling on screen 70 from one or more specific angles with respect the front face of display 47.

As depicted in FIG. 2, at least one user input 76 is accessible to the user on the front face of display 47. Here, user input 76 can be, for example, a knob, slider, button, etc., which is configured to allow the user to set and/or otherwise modify certain operative parameters associated with display 47. Most displays include separate user inputs 76 to control the brightness and contrast settings of display 47. Some displays also provide user inputs 76 to control color saturation, tone and/or hue. Certain displays allow for remote control of these settings, for example, through and application running on computer 20. These controllable settings/functions and their implementations are well known.

Figure 3:
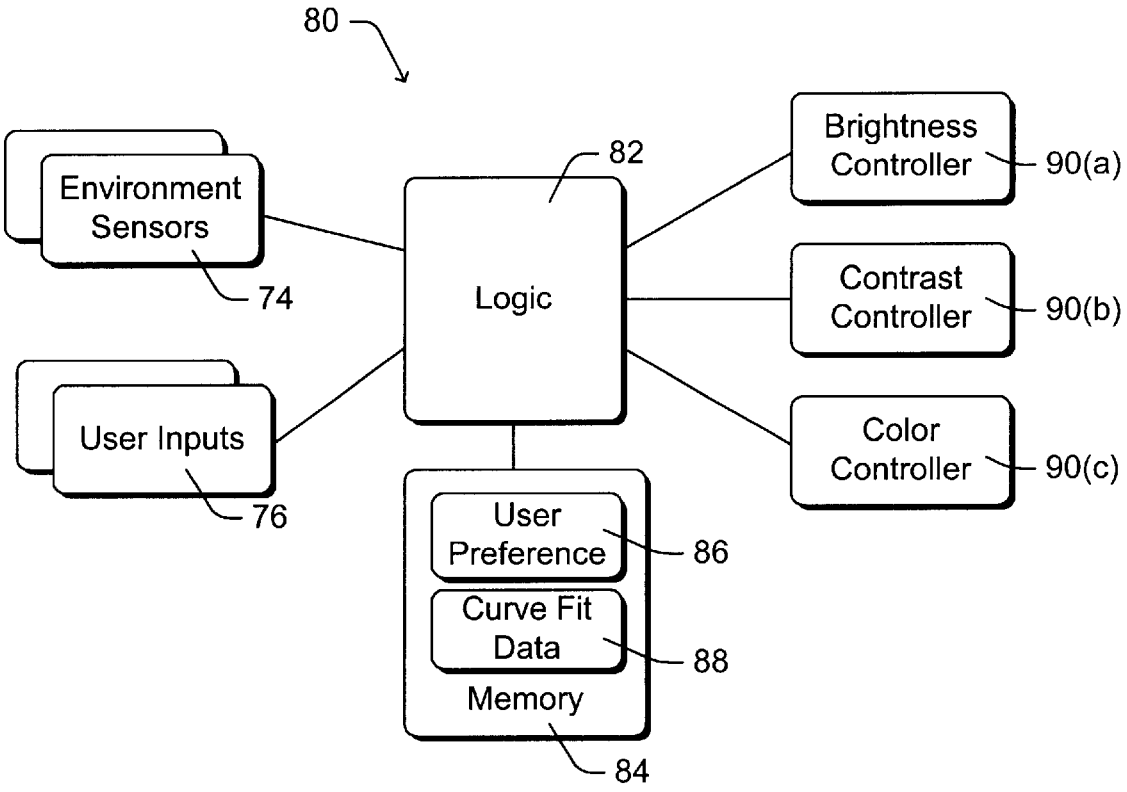
FIG. 3 is a block diagram depicting an arrangement for use in a display, for example, as in FIG. 1 for detecting changes in certain environmental conditions and responding to those detecting changes by selectively adjusting certain display settings.

Reference is now made to FIG. 3, which is a block diagram depicting an exemplary arrangement 80 for use with display 47. Those skilled in the art will recognize that arrangement 80 can be implemented using a variety of conventional hardware and/or software design techniques.

Arrangement 80 is configured to interact with the user, detect changes in certain environmental lighting conditions, and respond to the detected changes by selectively adjusting applicable display settings in an attempt to reduce the effects of such detectable changes to display 47. To accomplish this task, arrangement 80 includes at least one environment sensor 74, at least one user input 76, logic 82, memory 84, and at least one operative parameter controller 90.

As mentioned above, environment sensor 74 is configured to measure an approximate amount of light falling on screen 70. Thus, for example, environment sensor 74 can include one or more light sensing devices, such as, a circuit containing a photo diode, that is configured to output a signal corresponding to the amount of light measured. Environment sensor 74 provides this measurement to logic 82.

Logic 82 can include a programmable processor or other like circuit. In certain implementations, for example, an application-specific integrated circuit (ASIC) is used to provide logic 82. Logic 82 is further configured receive or otherwise monitor user settings via at least one user input 76.

Logic 82 is configured to selectively store these user settings in memory 84 as user preferences 86, along with any applicable measured environmental values from environment sensors 74. Logic 82 passes the user settings to at least one applicable operative parameter controller 90. Here, for example, the user settings are provided by logic 82 to brightness controller 90(*a*), contrast controller 90(*b*) and/or color controller 90(*c*), as applicable.

Arrangement 80 can be configured to allow the user to establish one or more user preferences 86. A user preference 86 can be established, for example, by having the user adjust the various user inputs 76 as required to provide acceptable viewing performance for the current lighting environment. Thereafter, when the environment lighting conditions are about the same, logic 82 will access user preferences 86 and set one or more of the controllers 90(*a–c*) to match the users preferences.

In certain implementations, the user establishes a dim lighting preference and a bright lighting preference. Here, a curve-fitting algorithm/data 88 can be used to provide the approximate settings for controllers 90(*a–c*). Thus, for example, if only one controller, e.g., brightness controller 90(*a*) is controlled by logic 82, then a two-dimensional curve-fitting algorithm may be employed. If brightness controller 90(*a*) and contrast controller 90(*b*) are controlled, then a three-dimensional curve-fitting algorithm may be employed. Similarly, if brightness controller 90(*a*), contrast controller 90(*b*), and color controller 90(*c*) are controlled, then a four-dimensional curve-fitting algorithm may be employed.

In this manner, the user should only be required to establish their preferred settings once. Thereafter, as the environmental lighting changes and is detected, arrangement 80 will make the requisite changes to the controlled settings. In certain implementations, arrangement 80 can be selectively enabled/disabled by the user.

In certain implementations, logic 82 and color controller 90(*c*) can be configured to adjust the color of display in response to the measured color in the environment. This requires environment sensor(s) 74 to measure certain frequencies of light. Thus, for example, if the room has a detected yellowish color then the hue of the display may be adjusted, as required, to normalize the displayed information.

In accordance with still further implementations, arrangement 80 can be applied to a projection display. Here, at least one environment sensor 74 can be located near the projection screen to detect and measure the amount of light falling on the screen.

Although some preferred embodiments of the various methods and arrangements of the present invention have been illustrated in the accompanying Drawings and described in the foregoing Detailed Description, it will be understood that the invention is not limited to the exemplary embodiments disclosed, but is capable of numerous rearrangements, modifications and substitutions without departing from the spirit of the invention as set forth and defined by the following claims.

I claim:

1. An arrangement for use with a display device, the arrangement comprising:

memory configured to store at least one preference value and n-dimensional curve-fitting data, wherein n is an integer greater than or equal to three and the n-dimensional curve-fitting data is generated using at least one substantially continuous curve-fitting algorithm;

at least one display parameter controller unit operatively associated with the display device and configured to respond to at least a first parameter setting and a second parameter setting selected from a group of settings comprising a brightness setting, a contrast setting, and a color setting;

at least one sensor unit responsive to light and configured to output a detected light value; and logic operatively coupled to the memory, the display parameter controller unit and the sensor unit, the logic being configured to output the at least first and second parameter settings based on at least the preference value, the n-dimensional curve-fitting data, and the detected light value.

2. The arrangement as recited in claim 1, wherein n is equal to at least four and the logic is further configured to output at least a third parameter setting also selected from the group of settings comprising a brightness setting, a contrast setting, and a color setting.

3. The arrangement as recited in claim 1, wherein the memory is further configured to store a plurality of preference values and based on the n-dimensional curve fitting data the logic is configured to use at least one additional significantly preferred preference value based on at least a portion of the plurality of preference values when outputting at least the first and second parameter settings.

4. The arrangement as recited in claim 3, wherein the plurality of preference values includes at least a bright environment preference value and a dim environment preference value.

5. The arrangement as recited in claim 1, wherein the preference value is a preferred brightness value.

6. The arrangement as recited in claim 1, wherein the preference value is a preferred contrast value.

7. The arrangement as recited in claim 1, the preference value is a preferred color value.

8. The arrangement as recited in claim 1, wherein the sensor unit is configured to be responsive to light falling within a selected portion of the visible light spectrum.

9. The arrangement as recited in claim 1, wherein the sensor unit is configured to be responsive to light coming from at least one specific direction with respect to the sensor unit.

10. A system comprising:

a computer; and a display device having the arrangement as recited in claim 1.

11. The arrangement as recited in claim 1, wherein the display device includes a projection screen.

12. A method for use with a display device, the method comprising:

establishing desired viewing data for the display device;

providing at least one substantially continuous n-dimensional curve-fitting algorithm associated with the desired viewing data, wherein n is an integer greater than or equal to three;

measuring an amount of ambient light falling on at least a portion of the display device and outputting a current light value;

determining at least two display operational parameters selected from among a group of operational parameters comprising a brightness parameter, a contrast parameter, and a color level parameter, as a function of the desired viewing data and the current light value as applied to the n-dimensional curve-fitting algorithm; and adjusting at least one display signal associated with the display device based on the at least two display operational parameters.

13. The method as recited in claim 12, wherein measuring the amount of ambient light falling on at least the portion of the display device further includes measuring a selected portion of the visible light spectrum.

14. The method as recited in claim 12, wherein measuring the amount of ambient light falling on at least the portion of the display device further includes measuring light coming from at least one specific direction with respect to the portion of the display device.

15. The method as recited in claim 12, wherein establishing the desired viewing data for the display device includes establishing at least one value selected from a group of values comprising a desired brightness value, a desired contrast value, and a desired color value.

16. The method as recited in claim 12, wherein the display device includes a projection screen.

* * * * *

UNITED STATES PATENT AND TRADEMARK OFFICE

CERTIFICATE OF CORRECTION

PATENT NO. : 6,618,045 B1
DATED : September 9, 2003
INVENTOR(S) : Lin

It is certified that error appears in the above-identified patent and that said Letters Patent is hereby corrected as shown below:

Column 3,
Line 22, delete number "19" between "23" and "represents".

Signed and Sealed this

Twenty-third Day of March, 2004

JON W. DUDAS
*Acting Director of the United States Patent and Trademark Office*